United States Patent [19]

Neuhierl

[11] Patent Number: 4,479,650

[45] Date of Patent: Oct. 30, 1984

[54] TOY-RACING EXPRESS MOTOR ROAD

[76] Inventor: Hermann Neuhierl, Waldstrasse 36, D-8510 Fürth/Bayern, Fed. Rep. of Germany

[21] Appl. No.: 371,554

[22] Filed: Apr. 26, 1982

[51] Int. Cl.[3] ..... A63F 9/14; A63H 18/08

[52] U.S. Cl. ..... 273/86 B; 238/10 F; 446/455; 104/304; 104/305

[58] Field of Search ..... 273/86 B; 46/259, 260, 46/261, 262, 257; 238/10 F

[56] References Cited

FOREIGN PATENT DOCUMENTS 2722734 11/1978 Fed. Rep. of Germany .... 273/86 B
2824756 12/1979 Fed. Rep. of Germany .... 273/86 B
2833159 2/1980 Fed. Rep. of Germany .... 273/86 B
2949046 6/1981 Fed. Rep. of Germany .... 273/86 B

*Primary Examiner*—Anton O. Oechsle

*Attorney, Agent, or Firm*—Wood, Dalton, Phillips, Mason & Rowe

[57] ABSTRACT

A toy-racing express motor road permitting a plurality of cars to be operated selectively as trackbound or freely steerable. The motor road includes track sections having across their entire length extension guide grooves, guiding edges, and current conductors. In the trackbound operation, a guide pin of the car catches in the guide groove. In the freely steerable operation, a guiding edge guides the car. The force-locking, or form-locking connection between the steering mechanism of a car and the driving mechanism of the car is interrupted in the trackbound operation as through the removal of a gear wheel. In a racing express motor road having several tracks with several current conductor pairs per travel track, different possibilities of play are possible as a matter of choice between an operation with only track-driven cars and an operation with only freely steerable cars.

12 Claims, 32 Drawing Figures

Servo A
Servo B
Spur A
Spur B
links
rechts
links
rechts
0123
0123
R
L
A
B

TOY-RACING EXPRESS MOTOR ROAD

BACKGROUND OF THE INVENTION

1. Field of the Invention

This invention concerns a toy-racing express motor road consisting of track sections arranged in a row with each other with at least one travel track with guiding means and with current conductors. A car is brought into electric contact with the current conductors. The car includes guiding elements by means of which it is transportable along the race track sections through a mutual catch.

2. Description of Background Art

Toy-racing express motor roads are known in two different model types. First, there are track-guided toy-racing express motor roads by which a downwardly projecting part on the car catches in a corresponding slot, groove, or formed slit in the race track sections. In the use of such toy-racing express motor roads, the respective car can only be controlled relative to its speed and is track-guided.

Another form of toy-racing express motor road exists wherein steering maneuvers causing a travel track shift are accomplished. In such toy-racing express motor roads, contacts are fixed on the cars to be in sliding electric contact with corresponding current conductors on the track. For deviation from a first path, the direction of rotation of the driving motor of the car is effected through the polarity reversal in a regulator in such a manner that suitable operation of a clutch, which is in force-locking or form-locking operative connection with the steering mechanism coordinated with the front wheels, is effected. The back wheels of the car drive the car regardless of the direction of rotation of the electric motor. The polarity changing mechanism of the regulator may simulate a steering wheel, so that the player receives an impression of a naturally true steering.

Relative to the toy-racing express motor roads with freely steerable cars, for example, reference is made to the German Patent DE-OS No. 27 22 734. Relative to the toy-racing express motor roads with trackbound cars, for example, reference is made to German Patent DE-OS No. 28 24 756.

These two types of known toy-racing express motor road systems appear incompatible. However, one arrangement has been suggested where both systems are used side by side (compare DE-OS No. 28 24 756). As shown, the track sections of both systems, which are connectable with each other, are placed in rows with each other and the car is provided with a guide piece which is under an initial elastic stress. The guide piece catches in the guiding groove because of the initial stress to be track-bound in this track section. Upon leaving the track section having the guiding groove, the guide piece is pivoted against a force of the spring and the car becomes freely steerable.

It is advantageous that the track sections of both systems be used side by side. However, such dual systems require that a selection be made as to in which track pieces the car is trackbound and in which the car is freely steerable. Further, only cars with the dual drive construction can be used, i.e. those that are steerable as well as display the retractable guide pieces.

SUMMARY OF THE INVENTION

The present invention provides a toy-racing express motor road selectively usable at the desire of the operator as a trackbound or a steerable type.

In accordance with the invention, this is accomplished by providing each travel track of each track section with a guide groove as well as a guiding edge over the entire extension of the travel track. Each car includes a guide pin for reception in the guide groove and border-sided keying devices for touching the mechanism on the guiding edge. Each car further includes a steering mechanism, which is controllable through the current conductors and the current collecting sliders.

In one form, the guide pin is rigidly, removably mounted on the car.

The removable mounting of the guide pin permits the operator to choose freely which type of operation he wants for a given car, i.e. the trackbound operation or the freely steerable operation, without the necessity of having cars specifically intended for one or the other of the different kinds of construction. Thus, the guide pin is installed for the track-bound operation, and the guide pin is removed for the steerable operation. Across the entire extent of the racing express motor road erected from track sections formed in accordance with the invention, both types of cars, i.e. trackbound cars and freely steerable cars, are workable in their respective operative condition independently of each other.

In the operation with the guide pin, the force-locking or form-locking connection can be connected or disconnected between the actuating electric motor and the steering mechanism. Further, the keying devices are detachable for the freely steerable operation. For this purpose, the guide groove is dimensioned in such a manner that the car's wide wheels cannot sink in. A simple interruption of the connection between the driving motor and the steering mechanism follows through the construction of a gear wheel. Forcible straight positioning of the front wheels in the trackbound operation is not necessary, as the friction is negligible and a simple spiral spring arranged in the usual manner with the front wheels or their axle spindles readily achieves the straight positioning.

The simple changeover of the car from a trackbound operation to a freely steerable operation and reversely results from making an assembly part connectable with the car rigidly but in a detachable manner (for example, by means of screws) on which assembly part selectively the guide pin is insertable, or the gear wheel is attachable.

The customary regulators for operation of the trackbound cars can be used with the limitation that no effect on the steering is effected. As mentioned, steering can be effected through the current polarity reversal by means of the regulators. In the operation of the trackbound car, regardless of the direction of the current, the back wheels always turn in the same forward driving direction.

As mentioned, the guiding devices can be mounted in a removable manner. However, if the track section is appropriately dimensioned as to the keying devices and the catch of the guide pin in the guide groove, the keying devices may be permanently mounted.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
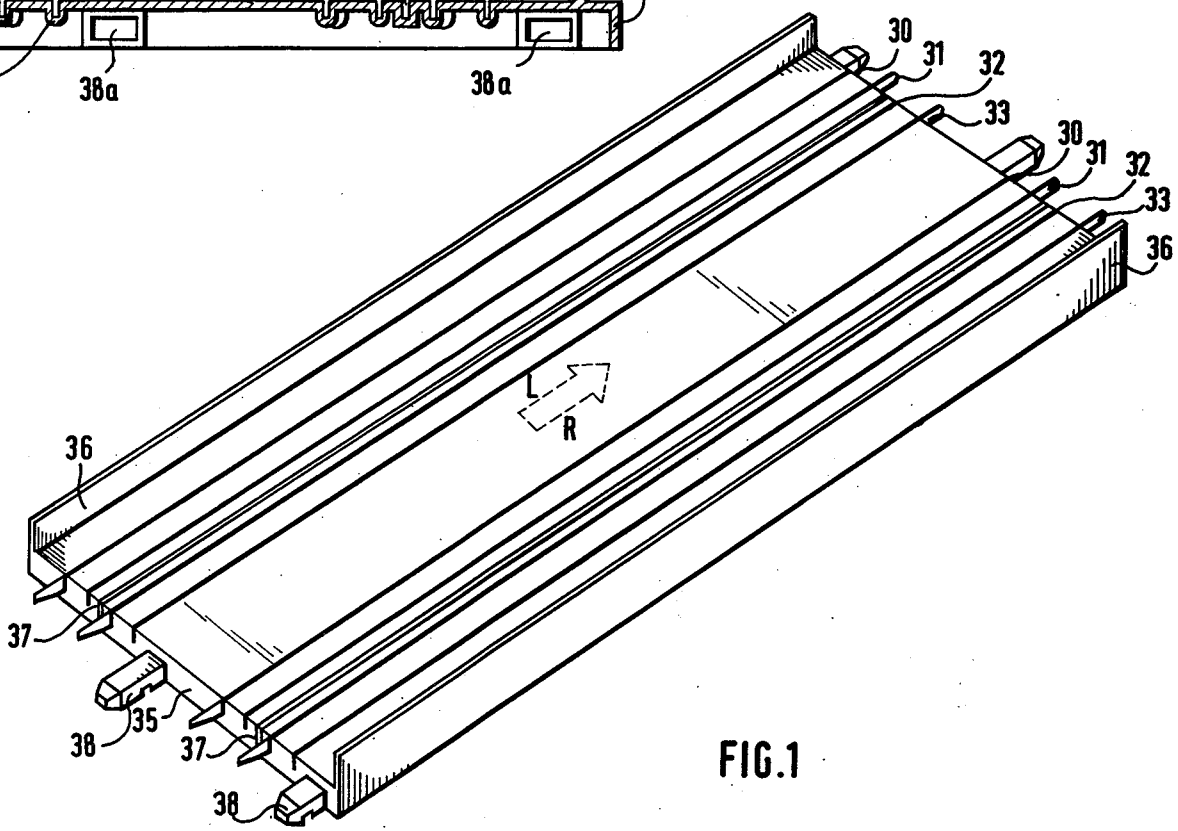
FIG. 1 is a perspective view of a track section embodying the invention.

In one embodiment of the invention as illustrated in FIG. 1, a straight track is shown generally at 90. A curved track section is constructed essentially in the same manner.

The track section 90 in FIG. 1 is constructed for a two-track operation with a right track R and a left track L. The travel direction on the tracks L, R, is in the direction of the arrow 12 represented in dotted lines. Each of the track sections 90 is constructed in substantially the same manner. Current conductors 30, 31, 32 and 33, a guide groove 37 and a guiding edge 36 extend along substantially the entire length of the track section 90.

While four current conductors 30, 31, 32, 33 are illustrated only two such current conductors are required. The current conductors 30, 31, 32, 33 are formed with conventional metal strips. Further, it is not essential for the guide grooves 37 to be located in the middle of the travel track. It is essential that one such guide groove 37 extend along the entire length of the track section. The car, which is movable along the length of the track section 90 has a guide pin 11 which is complementary with the guide groove 37 as will be explained subsequently.

Figure 2:
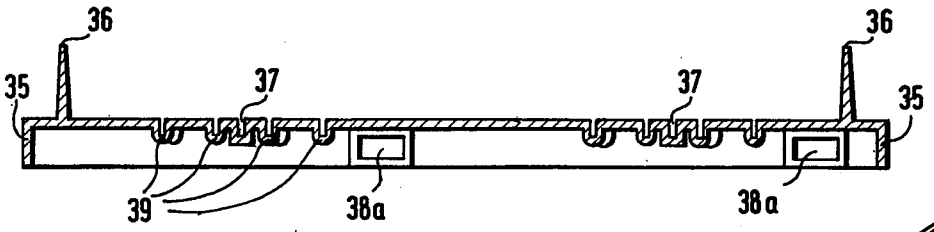
FIG. 2 is a transverse section of a track piece of the invention.

To detachably connect adjacent track sections, pin elements 38 are furnished, extend beyond the opposite free edges 14 of the track sections and are brought into contact with mating jack elements 38*a* (FIG. 2). To electrically connect the current conductors 30–33 of the adjacent track sections 90, individual current conductors project beyond the edges 14 and are constructed for pluglike connection in socketlike current conductors of the adjacent track sections, as is customary. For example, alternating conductors 31, 33 project beyond one edge 14 and are received in complementary socketlike conductors 131, 133 of the adjacent section 90. Preferably, the sections 90 are also reversible by reason of the arrangement of the pin elements 38, jack elements 380, conductors 30–33 and 131, 133 to facilitate lengthwise assembly of the sections 90.

By placing rows side by side over the linkage elements 38, 38*a* of more track pieces constructed in this way, a racing express track road is made on which freely steerable, as well as trackbound, cars can be driven. As a matter of choice, this possibility of utilization of trackbound, as well as freely steerable, cars opens up numerous new possibilities of play, as will be explained further by means of FIGS. 13–20.

Figure 3:
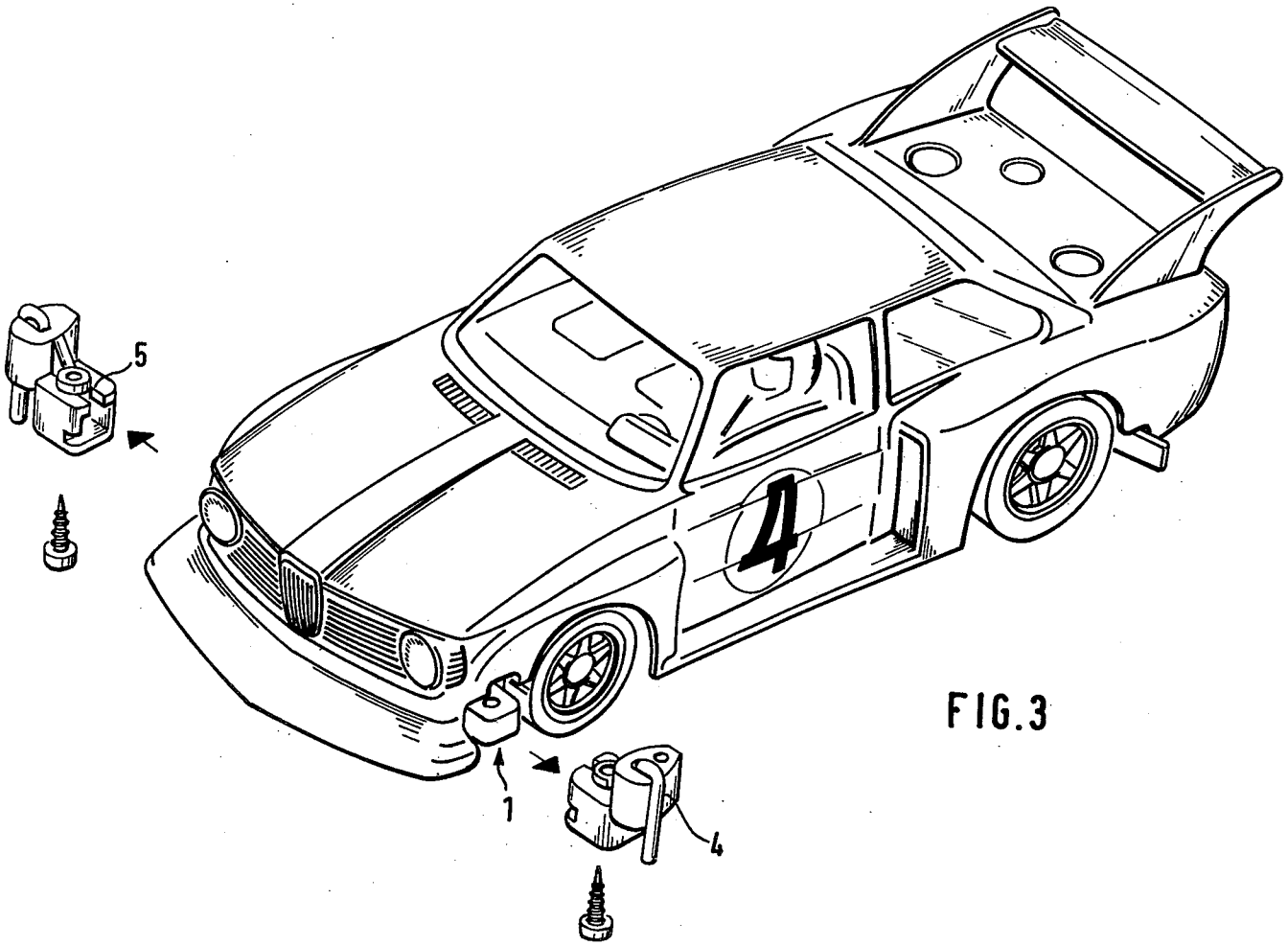
FIG. 3 is a top perspective exploded view of a car of the invention.

More advantageous are cars which, as desired, are used both as trackbound and as freely steerable cars. One such car will be thoroughly explained by means of FIGS. 3 and 5, as follows.

On a chassis, or bottom part, 1 of a car 100, a carriage 101 is fastened, and screwed on in an appropriate manner. The bottom part 1 carries (see FIG. 4) current collecting sliders 2 and 3, which are arranged to engage the current conductors 30–33 of the track section to supply an electric motor in the car (not illustrated) with energy. For the supply of energy, the car needs two current collection sliders 2, 3 and two current conductors which should not be used by another car on the same travel track. Otherwise, independent steering will no longer be possible as will be explained below.

In the simplest case, namely two trackbound cars on two travel tracks, only one pair of current conductors is required for each travel track. The number of different possibilities for play however, are thereby considerably limited. Because a freely steerable car must be provided with energy in both travel tracks only a single freely steerable car could be driven.

For this purpose, therefore, four current conductors are preferred, which can be chosen in pairs. At any given time, both inside located current conductors are used as a first pair. As a second pair, both outside current conductors are used. It should be mentioned that with three current conductors, one of the current conductors is common for both pairs.

Figures 4, 5:
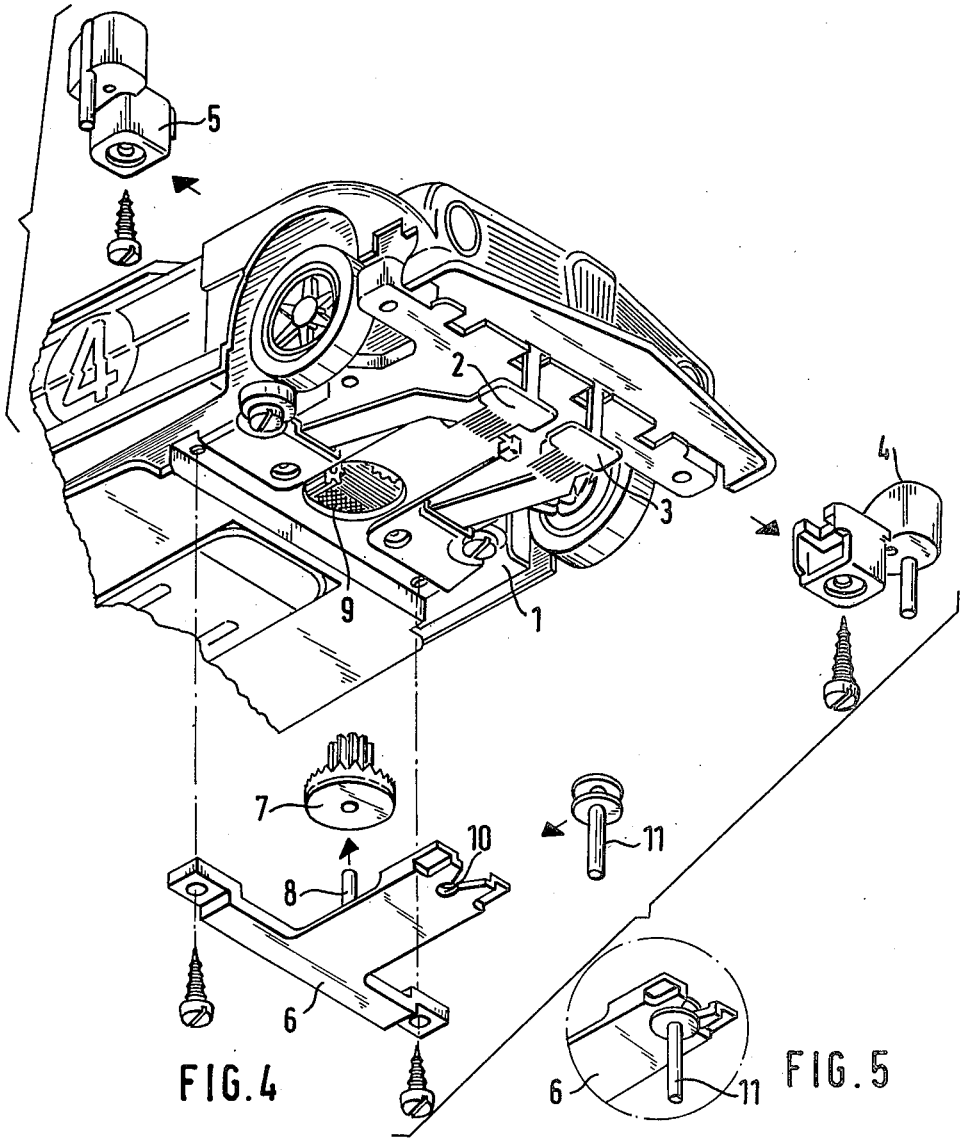
FIG. 4 is a bottom perspective exploded view of the front part of a car of the invention.
FIG. 5 is a fragmentary perspective view of the guide pin inserted into the receiving slot of an assembly part.

By means of an appropriate construction of the current collecting sliders 2, 3 as that illustrated in FIG. 4, a car can be changed over to an operation on the inside located or the outside located current conductors by changing the position of the sliders 2, 3. One such type model is known in the art and, therefore, will not be explained further.

On the bottom part 1, near the front wheels adjacent the sides of the car 100, keying devices 4 and 5 are fastened. In the illustrated model example, the devices 4, 5 are fastened by a screw connection in an exchangeable or removable manner. The keying devices cooperate with the guiding edge 36 during freely steerable operation and assist during a track exchange. Lap counters or the like can be provided, in known manner.

Further, on the bottom part 1, an assembly part 6 is fastened, and is essential for the changing over of the car, on one hand, as a trackbound car, and, on the other hand, as a freely steerable car. The assembly part 6 is loosely attached on the bottom part 1 by means of screws 103. However, it can be otherwise suitably attached as, for example, through snap connections, bayonet connections, rocking lever connections, locking connections, and the like. The assembly part 6 is constructed essentially in the shape of a "T". A receiving slot 10 is provided at the forward portion of the stem 104 of the "T" into which the guide pin 11 is insertable or can be clicked in, as shown in FIG. 5.

The assembly part 6, on the other hand, has a vertically directed post 8 onto which a gear 7 can be removably fixed. The bottom part 1 has an opening through which the gear can be introduced toward the inside of the car 100 and into contact with the engine pinion 9 of the not illustrated motor, which is electrically supplied through the current collecting sliders. A corresponding part, such as a gear rack 106 or the like, associated with the steering mechanism 12 (see FIGS. 6 and 8) for the car mates with the gear 7.

By employing the guide pin 11, which is inserted into the receiving slot 10 of the assembly part 6, the car can be operated in a trackbound manner, since the guide pin 11 catches in the guide groove 37, and, therefore, the car can be driven only along the guide groove 37. The electric motor acts only on the back driving wheels 108 of the car. To reduce friction losses, the connection between the electric motor and the steering mechanism 12 is interrupted, which is achieved by the removal of the gear 7. Usually a return spring (not shown) is furnished between both front wheels 118 or their axle spindles, through which, an automatic adjustment of the front wheels is effected with the gear removed. The wheels 118 assume a position parallel to the driving direction, whereby further friction losses are considerably lowered. The friction may be negligible so that the interruption of the force-locking or form-locking operative connection between the electric motor and the steering mechanism 12 as well as to a forcible straight adjustment of the front wheels may not be desired.

Further, it is not essential that the gear 7 be provided on the assembly part 6 in an exchangeable manner. On the contrary, the gear wheel 7 can be accessible in another way, as, for example, by separating the carriage from the bottom. Also, an interruption of the form-locking or force-locking connection between the electric motor and the steering mechanism 12 can be accomplished in a manner differently than heretofore described. However, the illustrated form with the gear 7, which can be set on the post 8 of the assembly part 6, and with the guide pin 11, which can be clicked into the receiving slot 10 of the assembly part 6, is preferred. In this way, therefore, a car is made which, as matter of choice, can be used as a trackbound car or also as a freely steerable car, whereby the changeover is very simple and can be easily undertaken by a layman. A quick change is possible from steerable cars to the track-guided cars, and vice-versa.

It should be mentioned that, when the distance between the guide pin 11 of a trackbound car and the guiding edge 36 is such that the keying devices do not engage the guiding edge, that the keying devices 4, 5 can be left on the car and, if desired, can be constructed in a nonremovable manner.

The principle of the operation will be explained further by means of FIGS. 6–9.

Figure 6:
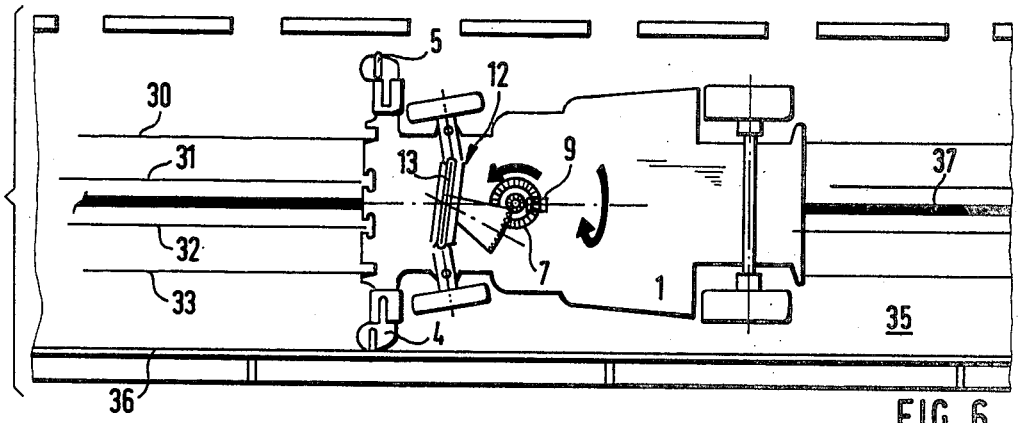
FIG. 6 is a plan view of the chassis of the car of FIG. 4 having a freely steerable front wheel means.
Figure 7:
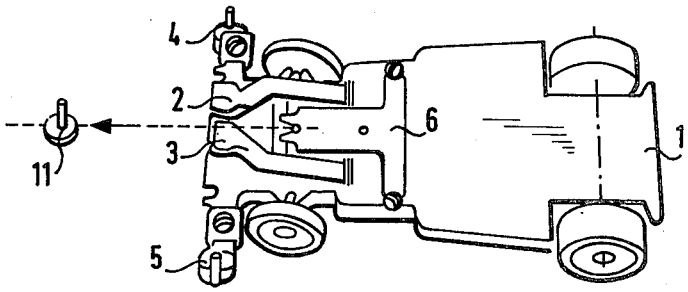
FIG. 7 is a bottom view of the car of FIG. 6.

FIGS. 6 and 7 show a car which is constructed for a freely steerable operation in which the gear wheel 7 is provided between the engine pinion 9 and the steering mechanism 12, and the keying devices 4 and 5 are mounted on the car. The energy is supplied for the electric motor through the current collecting sliders 2, 3. The motor drives a gear unit connection (not shown), which, through a conventional gearing mechanism effects rotation of the back wheels in the same direction independently of the polarity or the phase relationship of the current, supplied to the electric motor. The engine pinion on the other hand, can rotate in either a clockwise or counterclockwise direction depending on the polarity or the phase relationship of the current, which is supplied to the electric motor. A corresponding rotation of the front wheels is imparted to the steering mechanism 12. This operative method is known and, therefore, will not be separately explained.

Thus, the car is constructed for a freely steerable operation and, therefore, can be directed back and forth between both travel tracks R and L. It is only important that after each track exchange, the current collecting sliders 2, 3, at any given time come into electric contact with a conductor pair on the travel track, so that the driving energy can again be supplied for the back wheels. The keying devices 4, 5 assist driving of the car on the track by means of touching the mechanism on the guiding edge 36. The keying devices can also be constructed in such a way that they act on the steering mechanism 12 for the aligning of the front wheels (not illustrated).

It can be seen from FIG. 7 that the guide pin 11 is readily removable from assembly part 6 and that the gear wheel can be readily set on the post 8.

Figure 8:
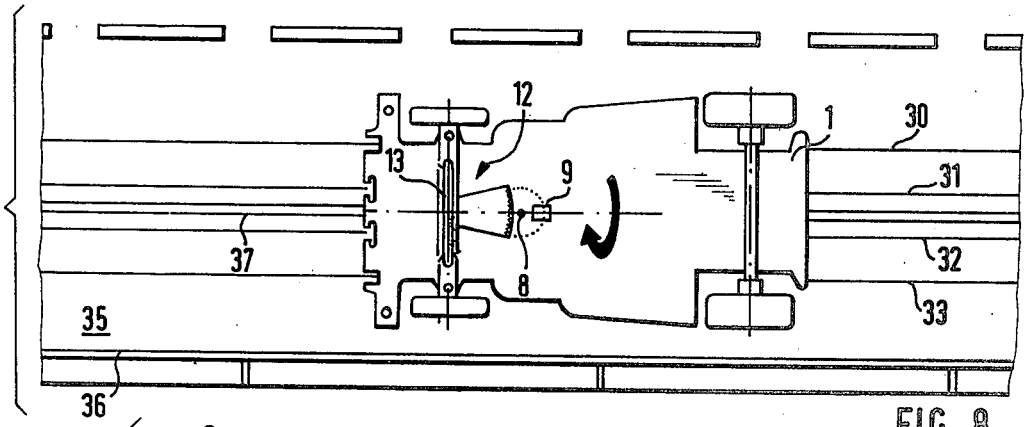
FIG. 8 is a plan view of the chassis of the car of FIG. 4 arranged as a trackbound car.
Figure 9:
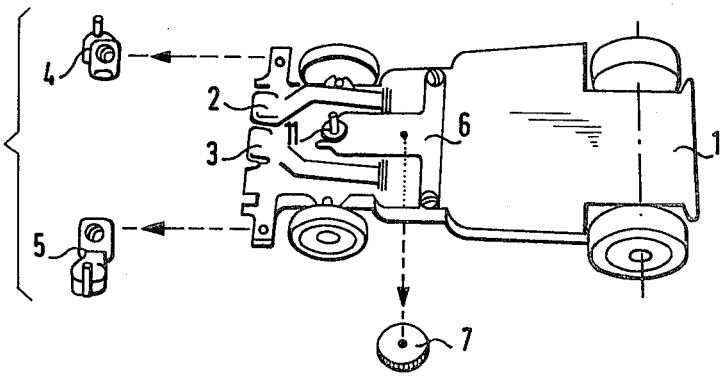
FIG. 9 is a bottom view of the car of FIG. 8.

FIGS. 8 and 9 show the model as a trackbound car by which the guide pin 11 is inserted, but with the gear 7 of the assembly part 6 removed for the interruption of the force-locking connection between the engine pinion 9 and the steering mechanism 12. The keying devices 4 and 5 are also disassembled in the model in FIGS. 8 and 9. The guide pin 11 catches in the guide groove 37, whereby the car is movable exclusively along this guide groove 37. The electric motor, as before, is supplied with energy through the current collecting sliders 2, 3 and drives, as before, the back wheels of the car.

The different possibilities of play (which can be freely chosen) for a toy-racing express motor road with two travel tracks R and L will be more thoroughly explained.

Figures 10A, 10B, 10C, 11A, 11B, 11C, 12:
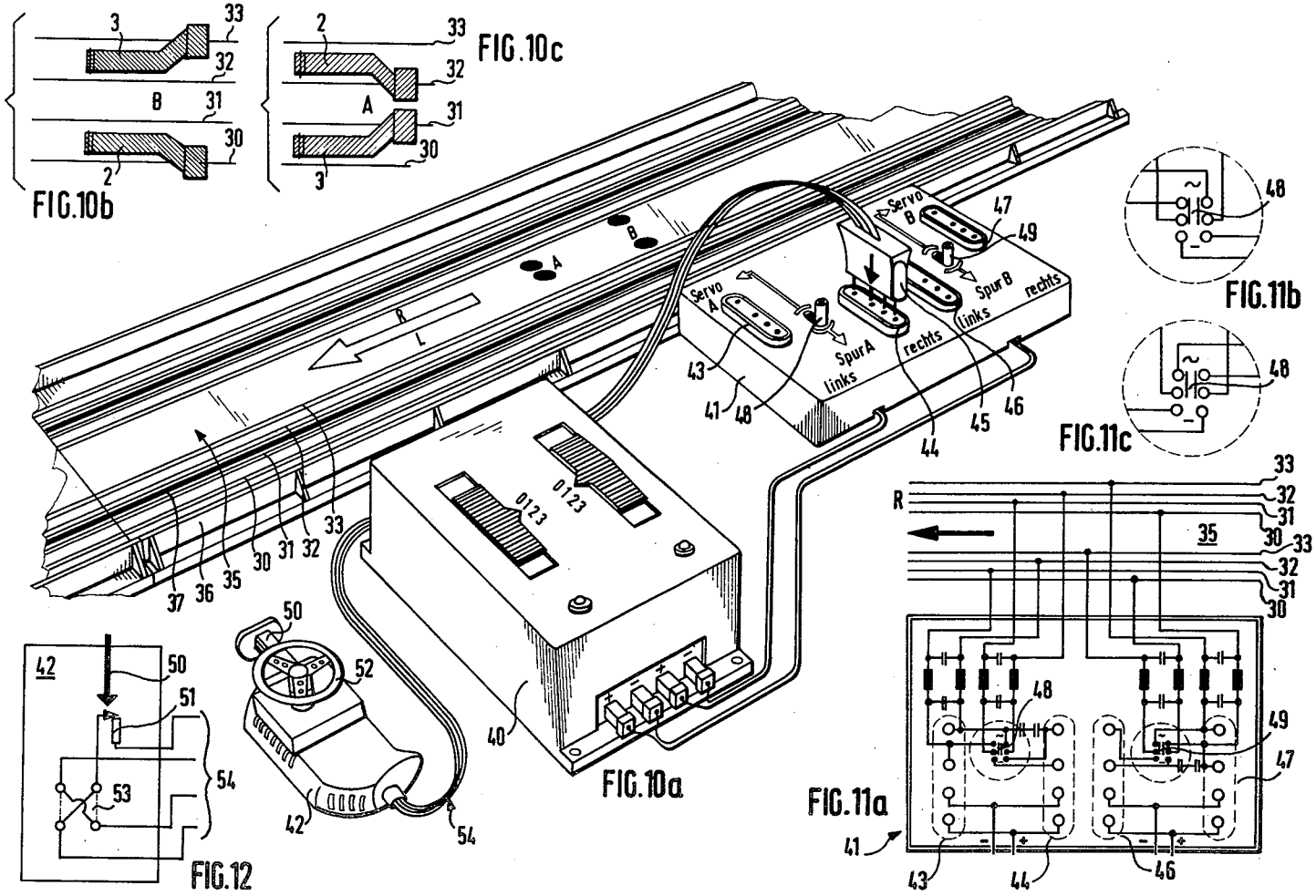
FIG. 10*a* is a perspective and schematic view of a toy-racing express motor road of the invention.
FIG. 10*b* is a plan view of current collecting sliders on the car in a first position engaging an outside pair of current carrying conductors on the track.
FIG. 10*c* is a plan view of the current carrying sliders of FIG. 10*b* adjusted to engage an inside pair of current carrying conductors on the track.
FIG. 11*a* is a schematic main circuit diagram of the connecting mechanism of FIG. 10.
FIG. 11*b* is a schematic diagram of a first slider switch on the connecting mechanism of FIG. 10*a* in a freely steerable position.
FIG. 11*c* is a schematic diagram of a second slider switch on the connecting mechanism in a freely steerable position.
FIG. 12 is a schematic circuit diagram of the regulator of FIG. 10.

FIG. 10*a* shows a track section 35 which is constructed in accordance with the invention. A current supply 40 is provided to which alternating current can be supplied from a power supply (not illustrated). From the supply 40 direct current can be adjustably supplied to a control mechanism 41. The control mechanism 41 distinguishes (as explained more thoroughly below) between cars identified as type A and cars of type B, as well as between trackbound and freely steerable operations. A regulator 42 is provided for each used car, and has an associated control circuit which is provided with a plug 45, which is selectively insertable into the corresponding plug sockets 43, 44, 46 or 47 of the control mechanism 41.

For purposes of illustration cars of type A are those by which the current collecting sliders 2, 3 are arranged on the car in such a manner that the electrical energy is supplied through the middle current conductor pair of each travel track, namely, the current conductors 31 and 32. Cars of type B have current collecting sliders 2, 3 reversely arranged from the ones on the cars of type A, in such a manner that the energy can be supplied to the car from the other current conductor pair.

Thereby, in the control mechanism, in its left part as viewed in FIG. 10*a*, cars of type A and, in its right part, cars of type B are controlled.

By means of a slider switch 48 (for cars of type A) or a slider switch 49 (for cars of type B) in the control mechanism either trackbound (bottom position "Track A" or "Track B") or freely steerable (top position "Servo A" or "Servo B") can be chosen. This, of course, can be correlated to the actual equipment of the car (see FIGS. 6 and 9). With a freely steerable car, the upper position of the slider switch 48 or 49 is chosen so that the ordered current conductor pair 31, 32 or 30, 33 supply both travel tracks in the same manner. If trackbound cars of the same type are used, then the lower position of the slider switch 48 or 49 is chosen, so that the pertinent current conductor pair 31, 22 or 30, 33 of each track can be provided, steered independently from each other.

Each regulator 42 is constructed for the control of a freely steerable car. The regulator has a lever 50 for changing speed, which acts on the slider of a potentiometer 51 in one of the circuits of cable 54. Further, the regulator 42 has a reverse polarity lever, which is constructed as a steering wheel 52 through which the steering operation is conducted, that is, through which a polarity reversal over a polarity reversal switch 53 (FIG. 12) is possible. Regardless of the placement of the reversal polarity switch 53, the electric motor of the car is driven in one or the other direction of rotation and, therefore, effects the steering direction with regard to the gear wheel 7 whereby a track exchange (by a freely steerable operation) is possible. Regulators 42 of this type of construction are conventional and, therefore, will not be explained more thoroughly. For example, reference is made to the regulator in German Patent DE-OS No. 27 22 734, wherein a lever can be clamped in a fixed position by means of a clamping mechanism.

In the upper position of the slider switch 48 or 49, the tracks are supplied by the ordered current conductor pair of both travel tracks by means of a regulator 42, while in the lower position of the slider switch 48 or 49 the tracks are supplied by the corresponding current conductor pair depending upon which of the plug sockets 43, 44, 46 or 47 into which the plug 45 of the regulator is inserted. This is further explained as follows.

Figure 13:
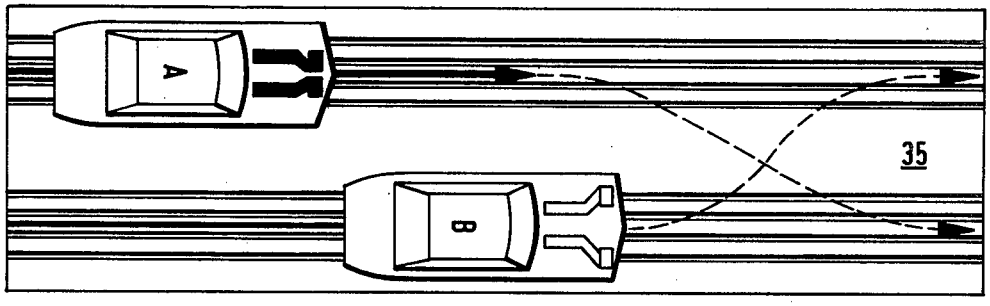
FIG. 13 is a plan view illustrating the manner of using the apparatus of the invention.
Figure 14A:
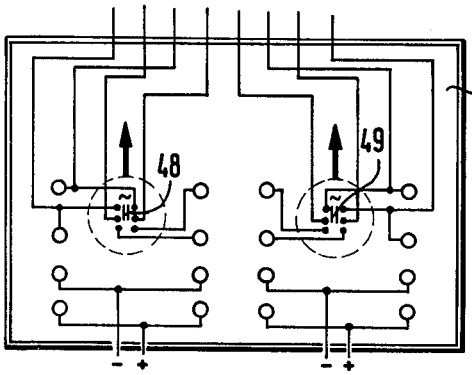
FIG. 14*a* is a schematic wiring diagram illustrating the electrical connections utilized in effecting the operation shown in FIG. 13.
Figure 14B:
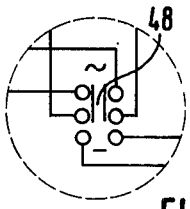
FIG. 14*b* is a schematic diagram of the first slider switch in a freely steerable position.
Figure 14C:
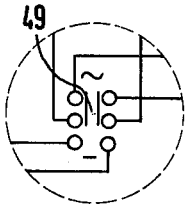
FIG. 14*c* is a schematic diagram of the second slide switch in a freely steerable position.

FIGS. 13 and 14 show a play form by which a car A, as well as a car B, are freely steerable. Thus, both slider switches 48 and 49 are in the upper position.

Figure 15:
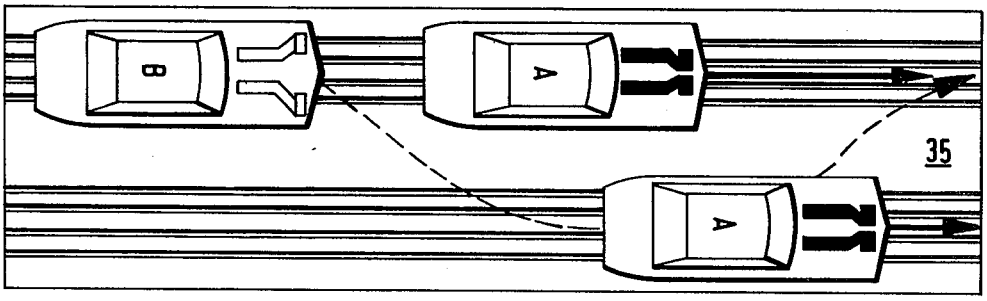
FIG. 15 is a plan view illustrating another manner of using the apparatus of the invention.
Figure 16A:
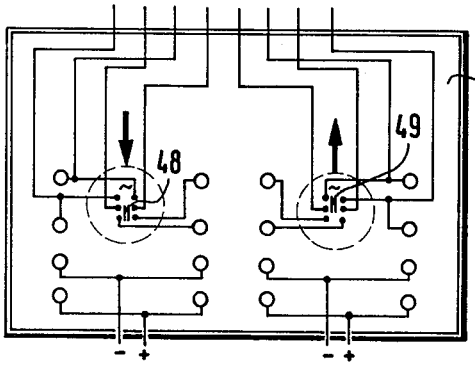
FIG. 16*a* is a schematic wiring diagram illustrating the electrical connections utilized in effecting the operation shown in FIG. 15.
Figure 16B:
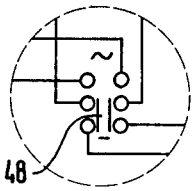
FIG. 16*b* is a schematic diagram of the first slider switch in a trackbound position.
Figure 16C:
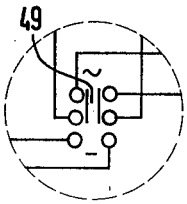
FIG. 16*c* is a schematic diagram of the second slider switch in a freely steerable position.

FIGS. 15 and 16 show a play operation by which a single freely steerable car B, and in each travel track a single trackbound car A, are provided. This means that the slider switch 48 is in the lower position and the slider switch 49 is in the upper position. The regulator 42 is connected through a plug 45 and a cable 54 to each of plug sockets 43 and 44 at the left part of the control mechanism.

Figure 17:
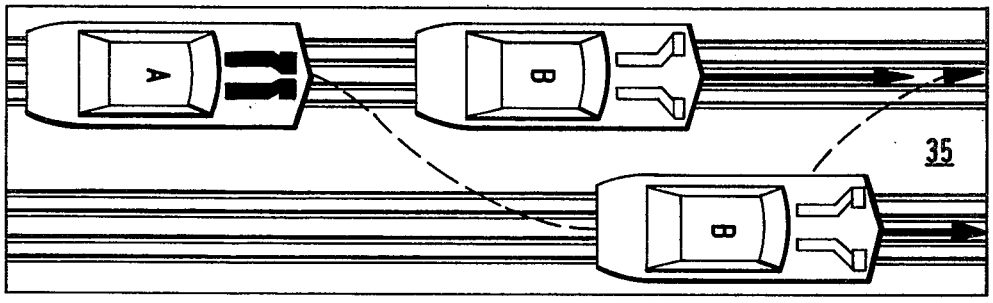
FIG. 17 is a plan view illustrating still another manner of using the apparatus of the invention.
Figure 18A:
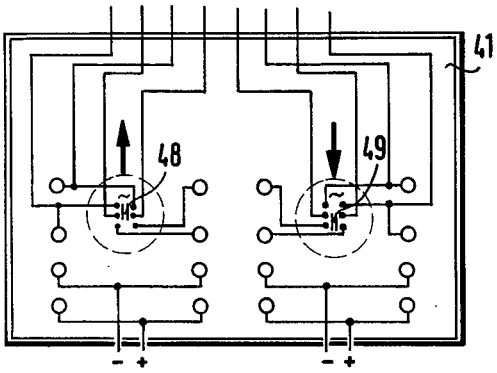
FIG. 18*a* is a schematic wiring diagram illustrating the electrical connections utilized in effecting the operation shown in FIG. 17.
Figure 18B:
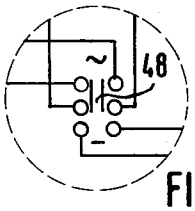
FIG. 18*b* is a schematic diagram of the first slider switch in a freely steerable position.
Figure 18C:
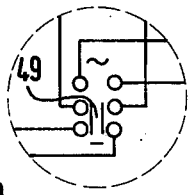
FIG. 18*c* is a schematic diagram of the second slider switch in a trackbound position.

FIGS. 17 and 18 show the reverse case, that is, a single, freely steerable car A, as well as in each travel track a single trackbound car B. In this case, the slider switch 48 is located in the upper position. The regulator is connected through cable 54 and plug 45 to each plug socket 46 and 47 in the right part of the control mechanism 41.

Figure 19:
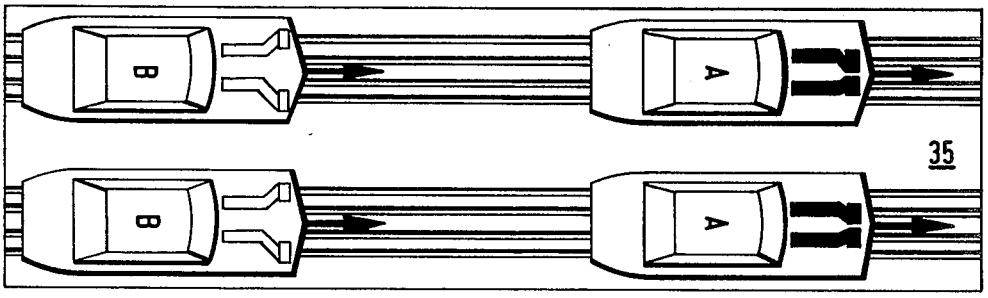
FIG. 19 is a plan view illustrating yet another manner of using the apparatus of the invention.
Figure 20A:
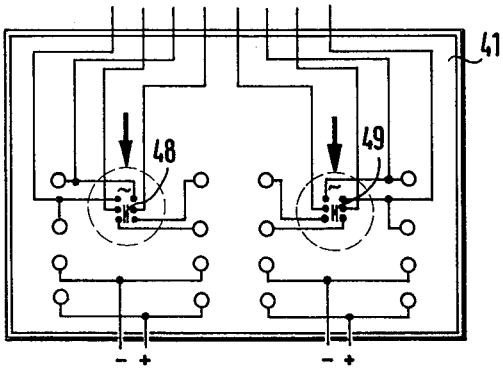
FIG. 20*a* is a schematic wiring diagram illustrating the electrical connections utilized in effecting the operation shown in FIG. 19.
Figure 20B:
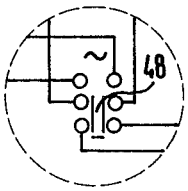
FIG. 20*b* is a schematic diagram of the first slider switch in a trackbound position.
Figure 20C:
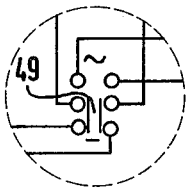
FIG. 20*c* is a schematic diagram of the second slider switch in a trackbound position.

Finally, FIGS. 19 and 20 show a play form wherein a trackbound car A and a trackbound car B are provided in each track. Both slider switches 48 and 49 are in their lower position and thereby for each car, regulators 42 are inserted into each plug socket 43, 44, 46 and 47 through a cable 54 and plug 45.

It should be noted that a trackbound car could be used in the upper position of the slider switch 48 or else when only one single regulator is used. Also several cars of the same type can be put in a travel track with a single regulator 42. However, in this way, the charm of the layout is decreased in a certain sense inasmuch as the regulator 42 acts on all these cars in the same manner. Automatic transport of these cars could be achieved which can be useful for a definite learning purpose, when one single car of the different type is freely steerable.

In the foregoing, a type model was explained by which the cars are driven by direct current. It is also possible to use low frequency, alternating current. Further cars are thereby additionally influenced independently from each other.

According to the invention (as it has been illustrated in detail) a toy-racing express motor road is provided which permits selection of freely steerable as well as track-driven cars. The motor road can be controlled to provide various combinations of steerable and non-steerable cars whereby various possibilities of play result (which have been thoroughly explained separately). Furthermore, the necessary current supply and the current regulators (which are required for the operation of the cars) need not be changed. The cars can be readily converted as choice dictates to either track-driven or freely steerable operation.

Of course, other type models are also possible.

What is claimed is:

1. A toy-racing express motor road system comprising:

a plurality of race track sections arranged serially and defining at least two side-by-side travel tracks defining a roadway, each said track having current conductors;

a pair of cars each having a drive means and current collecting means for establishing an electrical supply from said current conductors to said drive means;

means associated with each said travel track of each track section defining a guiding groove along the entire length of the section;

means at the opposite side edges of each track section defining a guiding edge along its entire length;

finger-removable guide means on each said car for selective cooperation with one of said guiding grooves for trackbound operation of the car along a selected one of said tracks;

side guide means on each said car for cooperating alternatively with either said guiding edge for freely steerable operation of the car; and steering means controllable through said current conductors and said current collecting means for controllably operating each of said cars selectively along said roadway in the trackbound mode with its guide means engaged in one of said grooves or the freely steerable mode with its guide means removed whereby said pair of cars may be raced along said roadway selectively with (a) each car being operated in the trackbound mode, (b) each car being operated in the freely steerable mode, or (c) either car being operated in the trackbound mode and the other car being operated in the freely steerable mode, as desired.

2. The toy-racing express motor road system in accordance with claim 1 wherein said keying device is detachably associated with the car.

3. The toy-racing motor road system in accordance with claim 1 wherein each said drive means comprises an electric motor, and means detachably connecting the electric motor and steering means.

4. The toy-racing motor road system in accordance with claim 3 wherein the electric motor has a pinion and the means detachably connecting the electric motor and steering means comprises a gear which can be disengaged from the electric motor pinion.

5. The toy-racing express motor road system in accordance with claim 4 wherein an assembly part is detachably connected to the car and said assembly part has an integral upright post which removably retains the gear.

6. The toy-racing express motor road system in accordance with claim 1 wherein a controllable regulator is provided to control current to the conductors and selectively actuate the steering means to selectively direct the car between the one track and the second track.

7. The toy-racing express motor road system in accordance with claim 1 wherein said current conductors include a first and second pair of current conductors of said first track and a third and fourth pair of current conductors of said second track.

8. The toy-racing express motor road system in accordance with claim 7 wherein said first pair of current conductors is spaced inside said second pair of current conductors and said current collecting means are adjustable to selectively contact either the first or second pair of current conductors.

9. The toy-racing express motor road system in accordance with claim 7 wherein a controllable regulator is provided to vary the current from the source of electric current to the first and third pairs of current conductors.

10. The toy-racing express motor road system in accordance with claim 7 wherein a plurality of regulators each control the current to a different pair of current conductors.

11. The toy-racing express motor road system in accordance with claim 7 wherein said guide means is removably snap-fitted to the car so that the car can be converted between said freely steerable and trackbound states.

12. The toy-racing express motor road system in accordance with claim 7 wherein a slider switch is electrically connected with said first track, said switch in a first position controlling current to the first and second pairs of current conductors in the same manner for a freely steerable car, said switch in a second position controlling current to the first and second pair independently for independent control of separate cars separately engaging said first and second pairs of current conductors.

* * * * *